United States Patent [19]

Tóth et al.

[11] Patent Number: 4,545,815

[45] Date of Patent: Oct. 8, 1985

[54] PROCESS FOR THE PRODUCTION OF STEELS OF LOW CARBON CONTENT WHEREIN THE CARBON END POINT AND BLOW TEMPERATURE ARE CONTROLLED

[75] Inventors: Lajos Tóth; Lajos Tolnay; László Kiss; István Sziklavaris; Miklós Aranyosi; László Zsiros; Ferenc Kiss; Lajos Kiss, all of Miskolc, Hungary

[73] Assignee: Lenin Kohaszati Muvek, Hungary

[21] Appl. No.: 640,766

[22] Filed: Aug. 14, 1984

[30] Foreign Application Priority Data

Aug. 26, 1984 [HU] Hungary ..... 2999

[51] Int. Cl.[4] ..... C21C 5/34

[52] U.S. Cl. ..... 75/49; 75/59.14

[58] Field of Search ..... 75/59, 49, 60

[56] References Cited

U.S. PATENT DOCUMENTS 3,649,246 3/1972 Fulton ..... 75/60

3,854,932 12/1974 Bishop ..... 75/60

*Primary Examiner*—Peter D. Rosenberg

*Attorney, Agent, or Firm*—Handal & Morofsky

[57] ABSTRACT

Subject of the invention is a process for the production of steels having low carbon content wherein oxygen is blowing under vacuum, the carbon end point and blow temperature are controlled, the tapping of the steels is followed by slag skimming, heating, refining under vacuum, then finishing and casting, where the oxygen is admitted into the melt through blow lance, the units of the system are water cooled and the generating flue gases are discharged from the system. According to the process of the invention the melt is flushed over with argon from underneath during the admission of the oxygen from the top through the blow lance; the composition, temperature and quantity of the emerging flue gases, as well as the temperature and quantity of the admitted and discharged cooling water are continuously measured, the argon intensity is controlled accordingly and the manipulations and technological steps are carried out according to the obtained measuring results.

5 Claims, 1 Drawing Figure

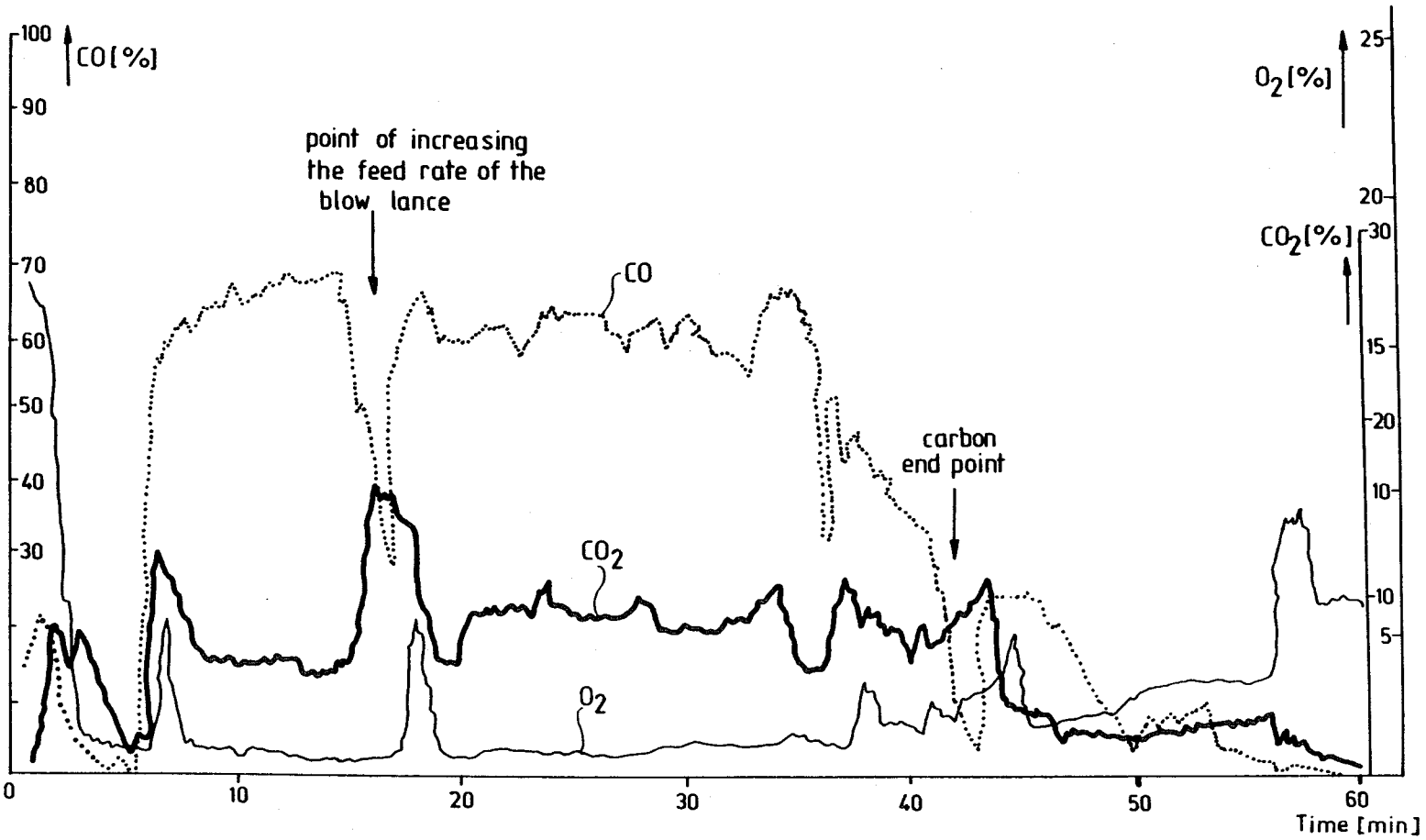
CO [%]
100
90
80
70
60
50
40
30
0
10
20
30
40
50
60
Time [min]
point of increasing the feed rate of the blow lance
CO
CO2
O2
carbon end point
O2 [%]
25
20
CO2 [%]
30
15
20
10
10
5

PROCESS FOR THE PRODUCTION OF STEELS OF LOW CARBON CONTENT WHEREIN THE CARBON END POINT AND BLOW TEMPERATURE ARE CONTROLLED

This invention relates to a process for the production of steels of low carbon content by blowing in oxygen under vacuum and by control of the carbon end point and blow temperature, wherein the tapping of the steel is followed by slag skimming, heating and casting, the oxygen is injected through blow lance into the melt, the units of the system are water cooled and the generating flue gases are discharged from the system.

Stainless steels have been produced since the turn of the century. During the decades elapsed since then three methods have been developed for the production of such steels: build-up, remelting and metal recovery methods.

According to the build-up method the charge is made up with carbon steel waste material, the melting is followed by refining of the carbon to 0.04–0.5%. The slag skimming, new slat formation and reduction are followed by alloying. Ferrochromium of super-low carbon content /C=0.06–0.006%/ is used for chromium alloying. The carbon content in the final composition of the so-produced ferritic and austenitic stainless steels is 0.08–0.10%.

The remelting process is used for the production of martensitic stainless steels /in case of C=0.12%/. This process allows the repeated utilization of the own /stainless/ waste steel. The melting is followed by slag reduction and alloying. The chromium alloying takes place with ferrochromium of low or high carbon content in function of the melting and the specified carbon.

With the process of metal recovery the increased reutilization of the anti-corrosive wastes of those of similar compositions with high Cr, Ni content can be realized.

The carbon is oxidized by oxygen blown through a lance /the length of which is reduced by melting/, while the temperature of the bath is gradually increasing /it exceeds 1800° C./. The refining is followed by slag reduction, alloying, desulphurization and the charge is tapped upon reaching the suitable composition and temperature of the bath.

The field of application of the stainless steels has been considerably extended during the recent years. The most significant field of application include the following: chemical industry, construction industry, medicinal instrument industry, health apparatuses, pressurized vessels, tanks, food-industrial, energetic, atom-energetic apparatuses, etc. The production of the stainless steels has suddenlly increased since the number of atomic power plants has been increasing. For example the internal structural elements of the thermal reactors in contact with the fissile material are produced from "ELC"-type austenitic chromium-nickel steel. Stainless steels of super-low carbon content alloyed with 1% boron are used for special purposes in the atomic industry.

The carbon content of the steels is particularly important in respect of corrosion-resistance. Intercrystalline corrosion occurs in the austenic steels over 0.03% carbon content, unless the carbon in the steel is bound with titanium or niobium. Stabilization of the carbon is not required below 0.03% C, because in this case the structure consists of pure austenite, and no corrosive process begins on the crystal boundaries either.

The selective carbon oxidation is highly significant in these processes, so that the concentration of the effective alloying elements does not diminish or only to a minimal extent and overheating of the steel bath does not take place.

During the refinment of the melts having chromium content at the carbon reactions of $$(C)+\tfrac{1}{2}(O_2)=(CO)$$

or $$2(C)+(O_2)=(CO_2)$$

the danger of Cr oxidation always exists in the stainless steels—for thermodynamic and kinematic reasons—according to the following equation:

$$2(Cr)+3/2(O_2)=(Cr_2O_3)$$

Accordingly, the process has to be controlled in order to achieve favourable conditions for the selective carbon oxidation. This is accomplished either with very high bath temperature /t>1800° C./ or with very low pressure of the CO gas.

The conventional acid-proof steel production utilizes the very high temperature in electric arc furnaces, which however was not preferable in view of cost and productivity.

During the oxygen refining under vacuum first of all the carbon content was refined with oxygen injected under vacuum and under different pressures, starting out of some kind of intermediate product in respect of the steel production, in which naturally not only Cr and Ni but high concentration of other elements too may occur /e.g. production of manganous steels/.

Although the overheating of the system is not expectable during the realization of such processes, yet is happens fairly frequently in the practice. The reason for this is, that the direct control of the production process is not possible, consequently the completion of refining takes place at an estimated carbon end point.

Further uncertainty is represented by the uncontrollability of the lance and by the subsequent over-blowings frequently resulting in bath temperatures over 1750° C.

In view of above, the bath became frequently overheated and the refractory brick wall of the pot-furnaces became frequently defective. The average life was 1–2 charge.

Furthermore, the diminishing of the blow lance too was fairly excessive and generally one blow lance was not sufficient for a whole charge.

The present invention accordingly provides a method for the production of steels of low carbon content, applying oxygen blowing under vacuum, wherein the end point of the blowing /in respect of the carbon content and temperature of the melt/ can be accurately determined and controlled and thus the overheating of the bath can be prevented.

According to the invention, oxygen blowing is carried out from above through the blow lance, the melt is flushed with argon from underneath and the temperature, quantity, furthermore the temperature of the admitted and discharged cooling water are continuously measured, the intensity of the argon is controlled accordingly and the manipulations and technological steps are conducted according to the obtained measuring results.

The temperature of the flue gas may be measured with nickel-chromium-nickel thermocouple, and first of all the carbonmonoxide, carbondioxide and oxygen contents are measured among the components of the flue gas.

The oxygen blowing is stopped according to the invention when at least 90% of the total oxygen quantity calculated for the blowing is already admitted into the melt and the quantity of the carbonmonoxide measured in the flue gas fell below 8%.

The postion of the blow lance too can be checked during the process according to the invention. The blow lance is immersed into the melt at the rate corresponding to the reduction of the blow lance and when the value of the carbondioxide in the flue gas suddenly increases upon the temperature rise of the flue gas and the value of the carbonmonoxide drops at the same time, then the lance is readjusted at increased rate until the ratio of $CO_2/CO$ is reset.

With the process according to the invention, safe, reliable and efficient production of stainless steels of super-low carbon content may be achieved. Upon completion of the blowing it is advisable to carry out the carbon-oxygen desoxidation under high vacuum, the time of which is determined by the final carbon content to be obtained. This is influenced by variation of the argon intensity.

The process is suitable for the production of special quality steels as well. Such are for example the following:

- steels of carbon content less than 0.03%. In case of stainless stells the stabilizing elements can be dispensed with, which represents economic advantage;
- super ferritic steels containing (C)+(N)≦ 120 ppm, Cr~18% and Mo~2% or Cr~25% and Mo~1%, the economic efficiency of which is represented by replacement of the Ni metal;
- Fe-Cr-Al type steels of super-low sulphur content for the purpose of resistance heating elements;
- Maraging steels;
- nickel-based alloys /e.g. 50% Ni, 18% Cr, 1% Si/ from waste alloy and the metallic chromium is brought into the alloy with ferrochromium carburizer. The process results in significant saving compared to the build-up process from the metal components of the inductive furcace;
- the presently produced heat-resistant steels /e.g. Ni=36%, Cr=16%, Si=2.0%/ and manganous steels /more economical as a result of the less expensive charge and better quality:less inclusions and lower gas content/;
- nitrogen micro-alloying is also feasible by nitrogen blowing through porous brick;
- castings /Pelton impulse wheel/ containing C≦0.003%, Cr~13%, Ni~4%;
- basic materials of dynamo and transformer plates with super-low carbon content and with high internal purity.

Further advantage of the process according to the invention is that it allows the fully automatic computer control of the process. This includes not only the lance control and determination of the oxygen requirement as well as the end point of the blowing with computer, but the calculation of the required quantity of the applied alloying elements, charge report, operation report, etc. as well.

The practical application of the process according to the invention took place for example as follows:

A charge was produced in an 80-ton arc furnace, then treated in ladle metallurgical unit. Slag skimming, new slag formation were followed by setting the initial blowing temperature in the heater unit.

The economic efficiency at composition of the charge in the arc furnace is characterized by the extensive use of the corrosion-resistant waste, and by supplementation of the chromium content with less expensive FeCr carburizer. The Ni and Mo are supplemented in the arc furnace with less expensive ferrous alloys /e.g. NiO, MoO, etc./. The rest of the metal charge is represented by unalloyed and poorly alloyed wastes during tapping with carburizer Mn, FeMn alloyed in the ladle. The low phosphorous content is particularly important in case of the charge materials, since desulphurization is not possible /or only at the expense of high chromium loss/. Consequently it is advisable to add known steel waste of low C, P content to the charge. The sulphur content represents no problem, since the conditions of desulphurization are given during the reducing period following the blowing.

Following the melting in the arc furnace, in order to obtain the 0.3% value of the C-content and 0.1–0.15% of the Si-content the oxygen blowing with the diminishing lance through the door is required during which the temperature may rise even to 1680°–1750° C., depending on the quantity of the elements to be oxidized. The quantity of the slag-forming materials must not exceed 15 kg/t, FeSi and Al grindings can be used for reduction. Since in the present case the slag can be skimmed off the charge by tipping of the slag-car, the slag is not skimmed in the arc furnace, but by letting the slag forward during tapping, the intensive mixing of the metal and slag is utilized in the ladle for the chromium reduction. The tapping temperature is 1660° C.

Following the slag removal with skimming machine, the composition of the steel is determined by sample taking and the temperature is measured. The alloying is to be corrected prior to blowing. The Cr and Mn are to be alloyed to the upper limit, while the Mo and Ni to the lower limit. The initial temperature of the blowing is to be determined according to the elements to be oxidized, so that the final blowing temperature should not exceed 1700° C. The initial temperature in case of C=0.3% is 1660–1620° C.

In order to maintain the final blowing temperature the initial value of Si=0.10–0.15% is the most favourable. Feeding of burnt lime has to be provided for still before the blowing, in order to reduce the unfavourable effect of $SiO_2$ upon the ladle-wall and dissolution of the slag in the $Cr_2O_3/B=2.5$.

The oxygen requirement is to be determined on the basis of the already mentioned calculation method, and the blowing can be commenced upon reaching the pressure of 13,300–16,000 Pa following the start-up of the vacuum steam-jet pump. The blowing intensity is initially 5, then 15 $Nm^3$/min. The tip of the oxygen lance is held 50 mm below the bath during blowing. The inspection hole of the vacuum and the TV camera allow only approximately the checking of the bath, because of the after-burning of the generated gases and splashing of the slag. About ⅔rd of the calculated oxygen quantity is blown in under the pressure of 13,300–16,000 Pa at maximal inductive mixing, then the remaining ⅓rd is admitted under pressure of 4000–5000 Pa at maximal inductive mixing and the argon gas is blown in at the rate of 150 l/min, in order to break through the chromous "slag-coat" and to increase the sensing of the vacuum of the metal bath.

The speed of C-oxidation decreases at the end of the blowing, which appears in the pressure drop of the reaction chamber, in fall of the flue gas temperature and reduction of the temperature step of the cooling water of the gas cooling system. At this stage, the flow intensity of the Ar gas is already 180 l/min. In case of correct end point, the temperature is within the range of 1680°–1700° C. Upon completion of the oxygen blowing, the carbon content of the bath is 0.03–0.05%, but the possibility of further C-oxidation is given in high vacuum under intensive inductive mixing and flushing with Ar gas.

The dissolved oxygen reacts with the carbon still present in the melt.

The boiling is followed with the reduction period. With the addition of CaO, $CaF_2$, then FeSi the slag formation, then parallel with the slag reduction the desulphurization takes place. The vacuum under 66 Pa kept for 20–25 minutes allows the formation of properly reduced liquid slag, and the carbon desoxidation too takes place at the same time. The basicity must have at least two values. According to the experience 97–98% Cr output can be obtained with the process after reduction in case of $Cr_2O_3$=5-7+.

The reduction is followed by the accurate setting of the temperature and the chemical composition, then the charge is handed over for casting.

The production process of an alloy with low carbon content is shown by way of example in the following Table, including the parameters of the technology, where the charge was 81500 kg, the cast weight 76 700 kg, the specific metal charge 1062 kg and the chromium recovery 96,9%.

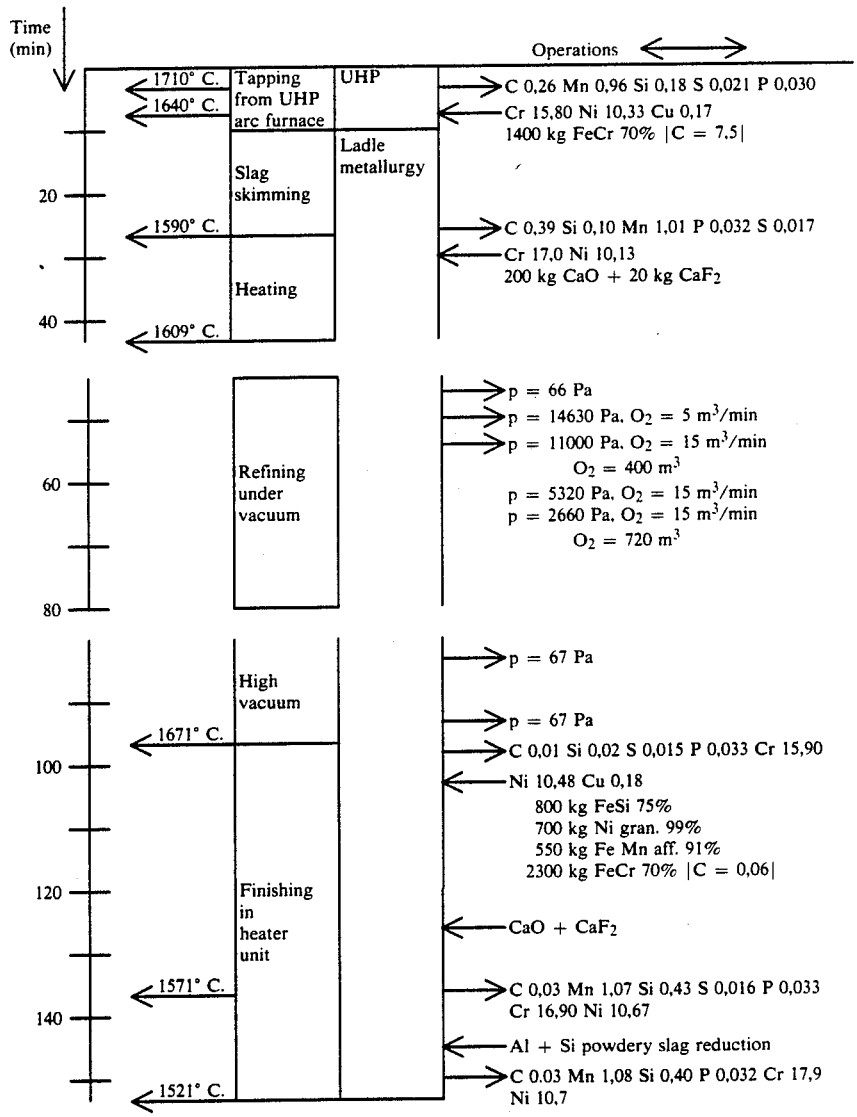

-continued

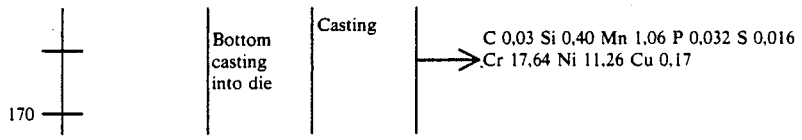

Further details of the process according to the invention are described in conjunction with a drawing showing the diagram of a typical gas composition variation during blowing and clean boiling.

The diagram clearly demonstrates the variation of the carbonomonoxide, carbondioxide and oxygen content in the flue gas during the technological steps.

It can be clearly seen that the carbonmonoxide content diminished suddenly before the 20th minute, while the carbondioxide and oxygen content increased suddenly at the same time. Evidently this means that the blow lance was not immersed in the melt. Consequently the feed rate of the lance was increased, upon which the measured values settled again on the suitable level.

The carbon end point is also clearly seen in the diagram. The carbonmonoxide content diminished at a fast rate, at the same time the carbondioxide and oxygen content increased towards the end of the blowing process. This clearly indicates the carbon end point.

In view of the foregoing it is apparent that the process according to the invention provides decisively new basis for the refining technology with oxygen blowing and thereby it offers nearly unlimited possibilities during the production of such types of steel.

What we claim is:

1. A process for the production of steels of low carbon content by blowing in oxygen under vacuum into the system, wherein the carbon end point and the blow temperature are controlled, the units of the system are water-cooled and the generated flue gases are discharged from the system, comprising the steps of:

(a) tapping of the steel;

(b) slag skimming of the melt;

(c) heating the melt;

(d) refining the melt under vacuum, wherein oxygen is admitted through a blow lance into the melt under high vacuum and under intensive and inductive mixing while flushing with argon;

(e) finishing and casting of the steel;

(f) continuously measuring the composition, temperature and quantity of the merging flue gases as well as the temperature and quantity of the admitted and discharged cooling water throughout the process; and (g) controlling the oxygen blowing and inductive mixing vacuum valves, as well as the argon intensity, in response to the data obtained by the measurements according to step (f).

2. Process as claimed in claim 1, characterized in that the temperature of the flue gases is measured by a nickel-chromium-nickel thermocouple.

3. Process as claimed in claim 1, characterized in that the carbonmonoxide, carbondioxide and oxygen contents of the flue gases are measured.

4. Process as claimed in claim 1, characterized in that the oxygen blowing is stopped when at least 90% of the oxygen calculated for the blowing is admitted into the melt and the quantity of carbonmonoxide measured in the flue gas is diminished below 8%.

5. Process as claimed in claim 1, characterized in that the blow lance is immersed into the melt at the rate corresponding to the reduction of the lance, and when the value of the carbondioxide present in the flue gas suddenly increases upon the temperature rise of the flue gas and the value of the carbonmonoxide decreases at the same time, then the lance is readjusted at an increased rate until the ratio of the carbondioxide and carbonmonoxide is reset.

* * * * *